US009664025B2

(12) United States Patent
Roberts

(10) Patent No.: US 9,664,025 B2
(45) Date of Patent: May 30, 2017

(54) PRESSURE BALANCING PROPPANT ADDITION METHOD AND APPARATUS

(75) Inventor: Robbie Roberts, Calgary (CA)

(73) Assignee: Step Energy Services LLC, Dover, DE (US)

( * ) Notice: Subject to any disclaimer, the term of this patent is extended or adjusted under 35 U.S.C. 154(b) by 1079 days.

(21) Appl. No.: 13/822,966

(22) PCT Filed: Sep. 16, 2011

(86) PCT No.: PCT/CA2011/050570

§ 371 (c)(1),
(2), (4) Date: Mar. 13, 2013

(87) PCT Pub. No.: WO2012/037676

PCT Pub. Date: Mar. 29, 2012

(65) Prior Publication Data

US 2013/0168086 A1 Jul. 4, 2013

Related U.S. Application Data

(60) Provisional application No. 61/383,934, filed on Sep. 17, 2010.

(51) Int. Cl.
*E21B 43/00* (2006.01)
*E21B 43/267* (2006.01)

(52) U.S. Cl.
CPC ..... *E21B 43/267* (2013.01)

(58) Field of Classification Search
CPC ..... B21B 43/26; E21B 43/267
See application file for complete search history.

(56) References Cited

U.S. PATENT DOCUMENTS

| | | | | |
|---|---|---|---|---|
| 5,899,272 | A | 5/1999 | Loree | |
| 7,121,156 | B2 * | 10/2006 | Anschutz | G01N 1/2202 73/863.61 |
| 2004/0206495 | A1 | 10/2004 | Lehman | |
| 2006/0289166 | A1 * | 12/2006 | Stromquist | E21B 43/267 166/305.1 |
| 2007/0137862 | A1 | 6/2007 | Stephenson | |
| 2007/0204991 | A1 | 9/2007 | Loree | |

FOREIGN PATENT DOCUMENTS

| | | | |
|---|---|---|---|
| CA | 2 648 265 | A1 | 10/2007 |
| CA | 2 715 622 | A1 | 8/2009 |
| CA | 2 649 203 | A1 | 6/2010 |

* cited by examiner

*Primary Examiner* — Tony G Soohoo
*Assistant Examiner* — Anshu Bhatia
(74) *Attorney, Agent, or Firm* — Christensen O'Connor Johnson Kindness PLLC

(57) ABSTRACT

A method and apparatus is disclosed for controlling the flow of proppant into frac fluid during a frac. A first pressure source pressurizes fluid within a proppant addition unit. Process piping receives proppant through a proppant supply passage for supply to a frac pressure pump. A second pressure source pressurizes fluid within the process piping. A first sensor senses pressure on a first side of the proppant supply passage and outputs a first signal. A second sensor senses pressure on the process piping on a second side of the proppant supply passage and outputs a second signal. A processor receives the first signal and the second signal, and outputs a control signal to at least one of the first pressure source and the second pressure source in response to the first signal and the second signal to control proppant flow into the process piping.

18 Claims, 2 Drawing Sheets

Fig. 1
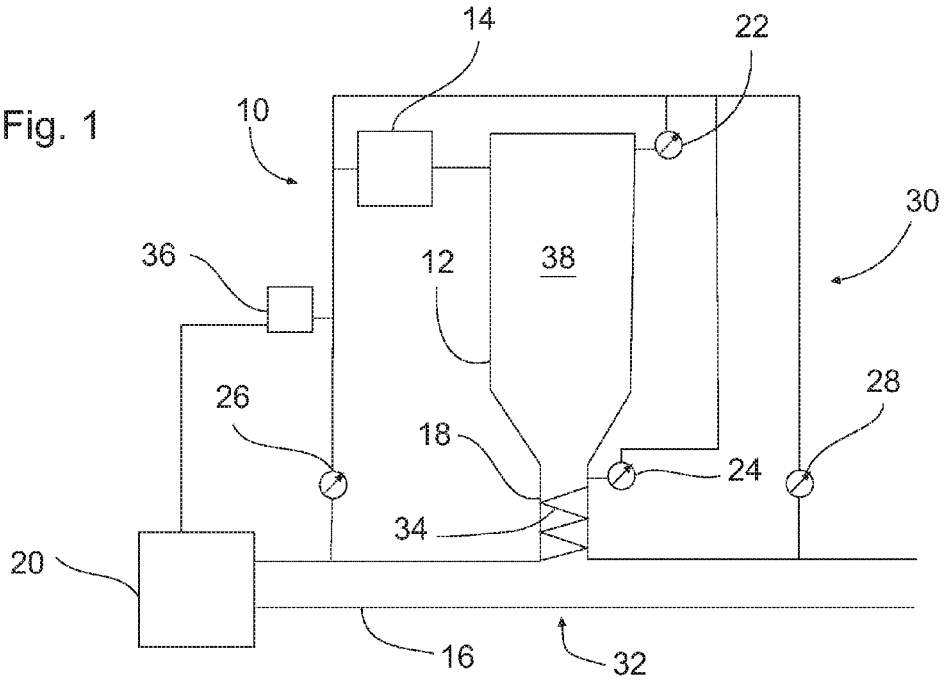
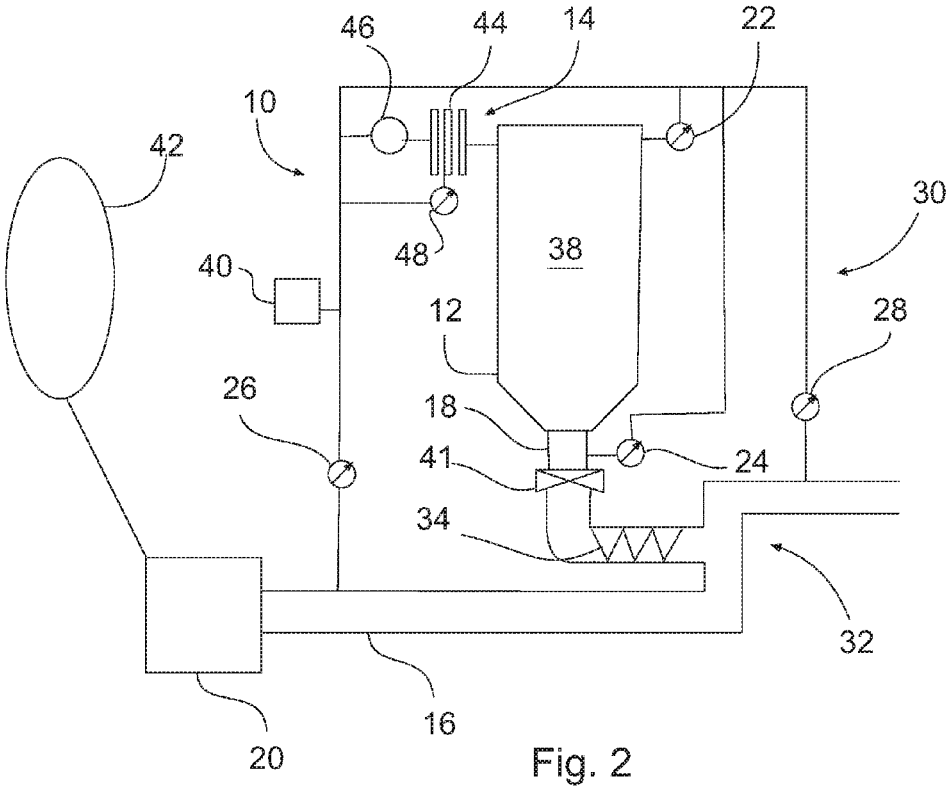
Fig. 2

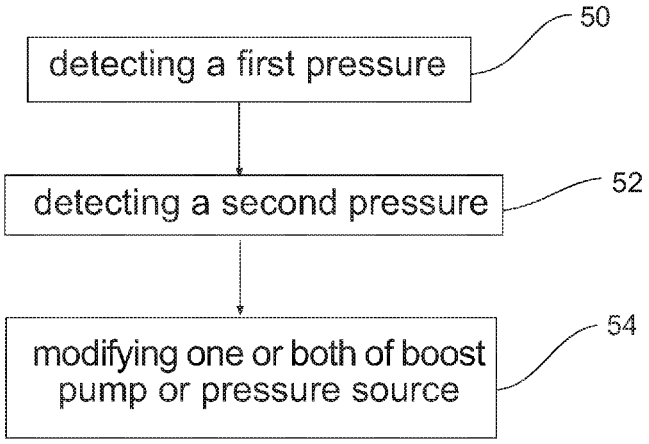
Fig. 3
Fig. 4
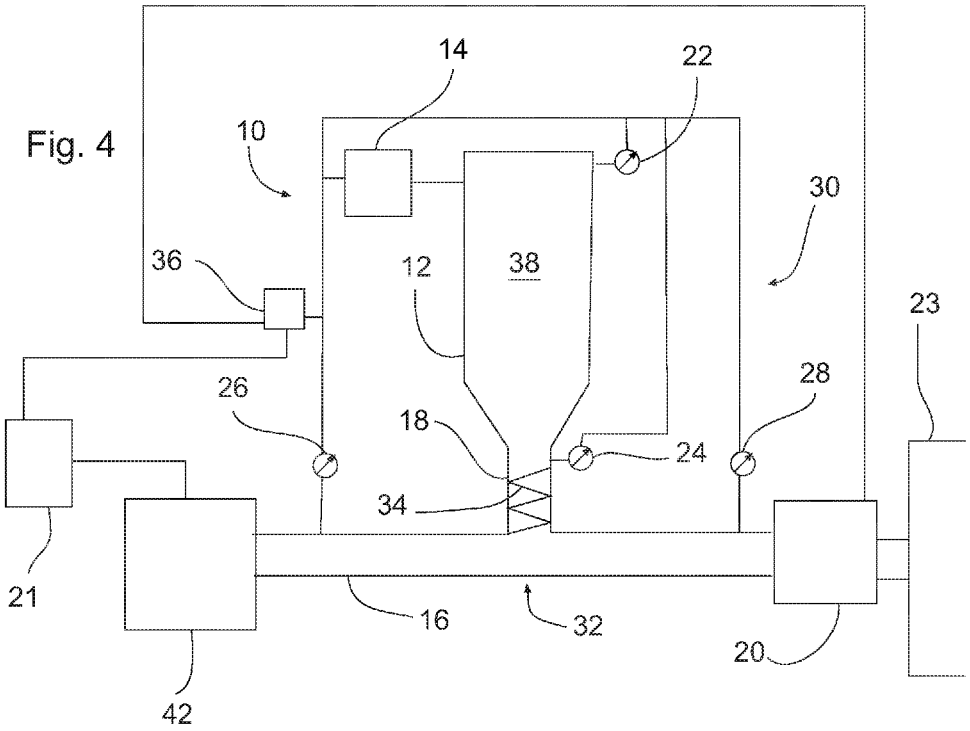

PRESSURE BALANCING PROPPANT ADDITION METHOD AND APPARATUS

TECHNICAL FIELD

This document relates to adding proppant to a well during hydraulic fracturing.

BACKGROUND

In hydraulic fracturing, frac fluids may be sent to a high pressure pump to be pumped down a well to fracture a formation. Typically, these frac fluids contain proppant supplied into the frac fluid for propping open fractures created in the formation by the pressure of the frac fluid. Proppant may be supplied into the frac fluid from a proppant addition unit.

SUMMARY

In one embodiment there is an apparatus, comprising: a proppant addition unit; a first pressure source connected to pressurize fluid within the proppant addition unit; process piping connected to receive proppant from the proppant addition unit through a proppant supply passage for supply to a frac pressure pump; a second pressure source connected to pressurize fluid within the process piping; a first sensor located to sense pressure on a first side of the proppant supply passage and having as output a first signal; a second sensor located to sense pressure on the process piping on a second side of the proppant supply passage and having as output a second signal; and a processor connected to receive as input the first signal and the second signal, the processor being further connected to output a control signal to at least one of the first pressure source and the second pressure source in response to the first signal and the second signal to control proppant flow into the process piping.

In one embodiment there is a method of regulating proppant flow into process piping, the process piping connected to receive proppant from a proppant addition unit through a proppant supply passage, the proppant addition unit connected to be pressurized at a first input pressure from a first pressure source, the process piping connected to be pressurized at a second input pressure from a second pressure source and to supply fluid to a frac pressure pump, the method comprising: detecting a first pressure on a proppant addition unit side of the proppant supply passage; detecting a second pressure on a process piping side of the proppant supply passage; and modifying the first input pressure, the second input pressure, or the first input pressure and the second input pressure in response to the first pressure and the second pressure to control proppant flow into the process piping.

In one embodiment there is an apparatus comprising a proppant addition unit. A pressure source is connected to provide pressurized fluid, such as pressurized gas, to the proppant addition unit. Process piping is connected to receive proppant from the proppant addition unit through a proppant supply passage, which may include a restriction. A boost pump is on the process piping. A first pressure sensor is located to sense pressure on a first side of the proppant supply passage, for example at the top of the proppant addition unit. The first pressure sensor has as output a first pressure signal. A second pressure sensor is located on the process piping to sense pressure on a second side of the proppant supply passage. The second pressure sensor has as output a second pressure signal A processor is connected to receive as input the first pressure signal and the second pressure signal. The processor is further connected to output a control signal to at least one of the boost pump and the pressure source in response to the first pressure signal and the second pressure signal to control proppant flow into the process piping. In some embodiments, more than two pressure sensors may be used, for example if there are pressure sensors on the process piping downstream and upstream of the proppant supply passage, and at the top and bottom of the proppant addition unit.

In one embodiment there is a method of regulating proppant flow into process piping. The process piping is connected to receive proppant from a proppant addition unit through a proppant supply passage. The proppant addition unit is connected to receive pressurized fluid such as gas at an input pressure from a pressure source. The process piping is connected to a boost pump, which may be controlled by hydraulic pressure, having a pump speed. The method comprises detecting a first pressure on a proppant addition unit side of the proppant supply passage. A second pressure is detected on a process piping side of the proppant supply passage. The pump speed, the input pressure, or the pump speed and the input pressure are then modified in response to the first pressure and the second pressure to control proppant flow into the process piping.

In various embodiments, there may be included any one or more of the following features: The first pressure source may be connected to supply a gas to the proppant addition unit. The pressurized fluid may comprise gas. The processor may be connected to output the control signal to the pressure source or first pressure source. The proppant supply passage may comprise an auger. The proppant supply passage may comprise a restriction. The second pressure source may comprise a boost pump. The boost pump may comprise a centrifugal pump. The second pressure source may be connected to supply a gas to a storage unit that is connected to supply frac fluid to the process piping. The first sensor and the second sensor may be pressure sensors. The proppant addition unit may comprise a proppant tank having a top and a bottom, with the first pressure sensor located at the top of the proppant tank. The proppant addition unit may comprise a proppant tank having a top and a bottom, and the first pressure sensor is located at the bottom of the proppant tank. The second pressure sensor may be connected to the process piping downstream of the proppant supply passage. A third pressure sensor may be connected to the process piping upstream of the proppant supply passage, the third pressure sensor being connected to the processor. The second pressure sensor may be connected to the process piping upstream of the proppant supply source. The first sensor may be one or more of a load sensor and a proppant level sensor. The processor may comprise a programmable logic controller. A storage unit may be connected to supply frac fluid to the boost pump. The processor may be connected to output the control signal to achieve a pressure differential between the first pressure signal and the second pressure signal that is within a predetermined range of pressure differentials. The processor may be connected to output the control signal to achieve a pressure differential, between the pressures on the first side and the second side of the proppant supply passage, that is within a predetermined range of pressure differentials. The second sensor may be upstream of the second pressure source. Modifying may comprise modifying the pump speed, the input pressure, or the pump speed and the input pressure to achieve a pressure differential between the first pressure and the second pressure that is within a predetermined range of pressure differentials. An average pressure differential of the predetermined range of pressure differentials may be reduced as the amount of proppant in the proppant addition unit is reduced. An auger speed of an auger within the proppant supply passage may be modified in response to the first pressure and the second pressure. The proppant addition unit may be connected to receive gas at the first input pressure from the first pressure source. Modifying may further comprise modifying the first input pressure, the second input pressure, or the first input pressure and the second input pressure to achieve a pressure differential between the first pressure and the second pressure that is within a predetermined range of pressure differentials. The second pressure source may comprise a boost pump, and modifying the second input pressure may comprise modifying a pump speed of the boost pump.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 1 is a schematic plan view of an embodiment of an apparatus for balancing pressures during proppant addition;

FIG. 2 is a schematic plan view of an embodiment of an apparatus for balancing pressures during proppant addition;

FIG. 3 is a flow diagram representing a method of balancing pressures during proppant addition; and FIG. 4 is a schematic plan view of an embodiment of an apparatus for balancing pressures during proppant addition.

DETAILED DESCRIPTION

FIG. 1 shows a proppant addition apparatus 10 comprising a proppant addition unit 12. A first pressure source 14 is connected to pressurize, for example by supply of pressurized fluid such as gas to, the proppant addition unit 12. Process piping 16 is connected to receive proppant from the proppant addition unit 12 through a proppant supply passage 18, which may comprise a restriction as shown. The process piping 16 may supply fluid to a frac pressure pump 23 (FIG. 4). A first side 30 of the proppant supply passage 18 includes the proppant addition unit 12. A second side 32 of the proppant supply passage includes the process piping 16. A second pressure source such as a boost pump 20 is connected to pressurize fluid within the process piping 16. Boost pump 20 may lie on the process piping 16. The proppant addition unit 12 may have a tank 38. A pressure sensor 22 may be attached at or near to the top of the tank 38. A pressure sensor 24 may be attached at or near to the bottom of the tank 38. The pressure sensor 22 or pressure sensor 24 may be used individually or in combination to provide pressure readings on the first side 30 of the proppant supply passage 18. A pressure sensor 26 may be attached to the process piping 16 downstream of the boost pump 20 but upstream of the proppant supply passage 18. A pressure sensor 28 may be attached to the process piping 16 downstream of the proppant supply passage 18. The pressure sensor 26 and pressure sensor 28 may be used individually or in combination to provide pressure readings on the second side 32 of the proppant supply passage 18. Thus, pressure sensors 26 and 28 may be used individually or in combination to provide pressure readings upstream or downstream of proppant supply passage 18. A processor 36 may be connected to the pressure sensors 22, 24, 26 and 28 to receive as input the signals from sensors 22, 24, 26, and 28. The processor 36, which may comprise one or more programmable logic controllers, is connected to at least one of the boost pump 20 and the pressure source 14, to output a control signal to at least one of the boost pump 20 and the pressure source 14 in response to the first pressure signal and the second pressure signal to control proppant flow into the process piping. The processor 36 may be connected to the pressure source 14 in one embodiment, and both the pressure source 14 and boost pump 20 in another embodiment. Pressure sensors 22, 24, 26, and 28 may be fed back to a driver unit for control. The driver unit may control the system off of only sensors 22 and 26 in one embodiment. Apparatus 10 allows proper flow of proppant into the frac fluid to be maintained during a frac, by maintaining a desired pressure balance between the flow of frac fluid and the pressure under which proppant is added to the frac fluid. Apparatus 10 may contain items not mentioned, such as items needed to allow proper flow of proppant.

As shown in FIG. 2, the proppant supply passage 18 may include an auger 34 to auger proppant into the process piping 16. The unit 12 may also comprise a valve 41, in order to control flow from unit 12. The pressure source 14 may include a valve, such as a Fisher control valve 44, and a gas source 46, thus allowing control of the amount of pressure put into the tank. The gas source 46 may be a tube trailer, for example containing $N_2$ gas, or a pumper. The valve 44 may comprise a proportional valve for precise control. The boost pump 20 may include a hydraulically controlled pump such as a centrifugal pump. The proppant addition unit 12 and the boost pump 20 may have a PLC controlling system 40. The application of the pressure balancing may be as follows: The tank 38 may be pressurized up with a gas, such as $N_2$ gas, and has an amount of proppant in the tank, for example 100 tonnes. The addition of the $N_2$ gas displaces the sand from the tank 38. The rate at which proppant is released from the tank 38 can be increased or decreased using the pressure $N_2$ gas. The pressure of the tank which may be read from the top of tank by pressure sensor 22 may be relayed through the PLC 40 to the boost pump 20. The tank pressure source 14 may be connected through a Fisher control valve 44. The valve 44 may be proportionally controlled. The boost pump 20 may be turning over and generating pressure as well. For example, at some point, there may be 280 psi on the proppant addition unit 12 and 250 psi on the boost pump 20. A storage unit 42 may supply fluid to the boost pump 20. The boost pump 20 may be located on a trailer.

To control the relative pressure a pressure differential code may be written in the PLC 40, which may include more than one PLC. It may be desirable to match the top tank pressure measured by pressure sensor 22 to the downstream side of the centrifugal pump measured by pressure sensor 26 or it may be desirable to operate the tank 38 at a slightly higher pressure than the process piping 16. The pressure of the tank 38 may also be slightly below the pressure of the process piping 16. In the case of trying to match pressure the number 0 may be inputted into the pressure differential code and the centrifugal pump may then increase or decrease RPM based on the pressure setting it is asked to achieve. Once the pressure sensor 26 downstream of the pump 20 reaches the same pressure as the top 22 of the tank 38 the boost pump 20 will maintain that pressure until the work is completed. In the case of keeping the tank pressure higher than the process piping 16 a negative number for example −1 or −2 may be inputted into the pressure differential code. The PLC 40 may then look at the top tank pressure and speed up the centrifugal pump 20. The centrifugal pump 20 would then maintain the downstream pressure of the piping 16 at 1 or 2 psi less than the tank pressure. The pressure balance of the tank 38 to the piping 16 may be required as proppant is added to the process piping 16 from the tank 38. If the pressure on the tank is maintained higher by for example 3-8 psi then the proppant flow may be too high to be controlled by the augers 34. This extra pressure may force more proppant into the process piping 16 and result in a higher concentration than is required from the job parameters. If the pressure is lower than the process piping 16 by for example 3-8 PSI then the proppant may not fill the augers 34 completely resulting in lower than desired proppant flow. The PLC 40 through operator input may then have to speed up the augers 34 due to a less than desired flow of proppant to the augers.

As shown in FIG. 3, a first pressure on the first side 30 (proppant addition unit side) of the proppant supply passage 18 (FIG. 2) is detected at 50, for example as may be detected by pressure sensor 26 or 28 (FIG. 2). A second pressure on the second side 32 (process piping side) of the proppant supply passage 18 (FIG. 2) is detected at 52, for example, as may be detected by pressure sensor 22 or 24 (FIG. 2). At 54, one or both of the pump speed of the boost pump 20 (FIG. 2) and the input pressure of the pressure source 14 (FIG. 2) is modified based on the detected first and second pressures.

Fluid may be supplied to the boost pump 20 (FIG. 2) under pressure, which ranges depending on ambient temperature. In some cases the fluid is capped with a gas pressure of at least 10 PSI from pressurized storage units 42 (FIG. 2). This extra pressure supplies positive head pressure to the centrifugal pump 20. For example, the fluid from the storage units 42 may be provided to the boost pump at 200 PSI regardless of the ambient pressure.

The fluid may be provided from the storage unit 42 to the boost pump 20. The boost pump 20 then increases the pressure by increasing the RPM of the pump. The higher pressurized fluid is then sent to the proppant addition unit 12.

The process piping 16 of the proppant addition unit 12 may be below the tank 38 and the higher pressurized fluid from the boost pump 20 may travel through this piping and out the end of this unit where it is fed to frac pumps, such as high pressure positive displacement pumps (not shown) which pump this fluid into the well. As the fluid is passing through the process piping 16, proppant is regulated into this fluid stream by a process controlled auger system 34. The auger speed of auger 34 may be modified based on the detected first and second pressures in order to supplement or replace the modification by one or both of the pump 20 or addition unit 12.

The processor 36 may be connected to output the control signal to achieve a pressure differential between the pressure signals that is within a predetermined range of pressure differentials The pump speed, the input pressure, or the pump speed and the input pressure may be modified to achieve a desired pressure differential, for example by reducing a differential between the first pressure and the second pressure when the first pressure and second pressure vary by more than a predetermined threshold. For example, the predetermined threshold may be −5 to 5 psi. In some embodiments an average pressure differential of the predetermined range of pressure differentials is reduced as the amount of proppant in the proppant addition unit is reduced. For example, a 20 psi differential may be tolerated when proppant addition unit 12 is full, while only a 5 psi differential may be allowed when the proppant addition unit 12 is a quarter full. The size of the differential may also be proportional to the specific gravity of the proppant, with a higher differential allowable for proppant with a higher specific gravity, as the weight and density of the proppant aid the overhead pressure in supplying proppant from the tank. By adjusting the pressure differential, controlled flow of proppant into the stream is achieved, and pressure fluctuations that cause oscillations and uncertain proppant injection are avoided.

Although the sensors 22, 24, 26, and 28 are described above as pressure sensors, other sensors may be used to directly or indirectly determine the pressure on both sides of the proppant supply passage. For example, one or both of the first sensors 22 or 24 may be one or both a load sensor or a proppant level sensor. A load sensor may be a type of pressure sensor at the base of the interior of the proppant addition unit or underneath the proppant addition unit for measuring the weight of proppant in the unit to allow calculation of the relevant pressure in the proppant addition unit. A proppant level sensor, such as a time domain reflectometry sensor at the top of the interior of the proppant addition unit, may indirectly sense pressure by supplying proppant height measurements to the controller for calculations to be made to determine the amount of proppant in the proppant addition unit and hence the relevant pressure.

Although the second pressure sensor is described above as being downstream of the second pressure source, for example the boost pump 20, FIG. 4 illustrates an embodiment where the second sensor, for example one or both of sensors 26 and 28, may be upstream of the second pressure source, for example the boost pump 20.

Although a boost pump 20 is described above as being the second pressure source, other second pressure sources may be used. For example the second pressure source may be a source 21 connected to supply a pressurized fluid such as gas to a storage unit 42 that is connected to supply frac fluid to the process piping 16. The controller 36 may thus balance pressure across the proppant supply passage by adjusting one or both of the input pressures of each of the first and second pressure sources.

The proppant may be a sand or other suitable proppant. The relative pressure of the first and second sides of the proppant supply passage may also be controlled by increasing or decreasing the pressure with which fluid such as gas is introduced from the pressure source 14 into the tank 38 using the PLC 40. Balancing of the relative pressure between the proppant addition unit 12 and the process piping 16 may be provided by using only two pressure sensors, one on each side of the proppant supply passage 18. For example, pressure sensor 22 and pressure sensor 26 can provide the pressure at the top of the tank 38 and the pressure produced by the boost pump 20. Pressure sensors 24 and 28 may also be used to calculate the pressure at the bottom of the tank 38 and the pressure in the process piping 16, respectively. The information provided by a pair of pressure sensors on either side of the proppant supply passage 18 may be sufficient to balance the pressure between the tank 38 and the process piping 16. Balancing of pressure in this document refers not only to equalizing pressures but also to maintaining the pressure differences within a suitable range. The pressure difference between the process piping 16 and the tank 38 should be regulated to ensure that the flow of proppant into the well is not too high or too low. The boost pump may be any type of pump that is suitable for pumping fracturing fluid into the well, and for example may be a centrifugal pump as shown in FIG. 2. Liquid, such as frac fluid may be supplied to the proppant addition unit 12, in order to wet the proppant and create a pressure seal between gas used to pressure up unit 12 and fluid in the process piping 16. The desired threshold pressure differential may differ depending on what sensors are used to measure pressures in the system. Pressure sensors may be transducers.

Immaterial modifications may be made to the embodiments described here without departing from what is covered by the claims.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of regulating proppant flow into process piping, the process piping connected to receive proppant from a proppant addition unit through a proppant supply passage, the proppant addition unit connected to be pressurized at a first input pressure from a first gas pressure source, the process piping connected to be pressurized with a liquid frac fluid at a second input pressure from a boost pump and to supply the liquid frac fluid to a frac pressure pump, the method comprising:

detecting a first pressure of a gas on a proppant addition unit side of the proppant supply passage;

detecting a second pressure of the liquid frac fluid on a process piping side of the proppant supply passage; and modifying a pump speed of the boost pump to adjust only the second pressure in response to the first pressure and the second pressure to control proppant flow into the process piping.

2. The method of claim 1 in which the proppant addition unit is connected to receive nitrogen gas at the first input pressure from the first gas pressure source.

3. The method of claim 1 in which modifying further comprises modifying the pump speed of the boost pump to achieve a pressure differential between the first pressure and the second pressure that is within a predetermined range of pressure differentials.

4. The method of claim 3 in which an average pressure differential of the predetermined range of pressure differentials is reduced as the amount of proppant in the proppant addition unit is reduced.

5. The method of claim 1 further comprising modifying an auger speed of an auger within the proppant supply passage in response to the first pressure and the second pressure.

6. The method of claim 1 further comprising wetting the proppant in the proppant addition unit to create a pressure seal between the gas in the proppant addition unit and the liquid frac fluid.

7. The method of claim 1 further comprising gas capping the liquid frac fluid upstream of the boost pump to supply a positive head pressure to the boost pump.

8. The method of claim 3 wherein modifying the pump speed of the boost pump results in the first pressure being lower than the second pressure such that the pressure differential is a negative pressure differential.

9. The method of claim 1 wherein modifying the pump speed of the boost pump results in the first pressure being higher than the second pressure such that the pressure differential is a positive pressure differential.

10. The method of claim 1 further comprising modifying a gas pressure from the first gas pressure source.

11. A method of regulating proppant flow into process piping, the process piping connected to receive proppant from a proppant addition unit through a proppant supply passage, the proppant addition unit connected to be pressurized at a first input pressure from a first gas pressure source, the process piping connected to be pressurized with a liquid frac fluid at a second input pressure from a second pressure source and to supply the liquid frac fluid to a frac pressure pump, the method comprising:

detecting a first pressure of a gas on a proppant addition unit side of the proppant supply passage;

detecting a second pressure of the liquid frac fluid on a process piping side of the proppant supply passage; and increasing the first input pressure apart from any modification of the second input pressure, in response to the first pressure and the second pressure to control proppant flow into the process piping.

12. The method of claim 11 in which the proppant addition unit is connected to receive nitrogen gas at the first input pressure from the first gas pressure source.

13. The method of claim 11 wherein increasing the first input pressure achieves a pressure differential between the first pressure and the second pressure that is within a predetermined range of pressure differentials.

14. The method of claim 13 in which an average pressure differential of the predetermined range of pressure differentials is reduced as the amount of proppant in the proppant addition unit is reduced.

15. The method of claim 13 wherein increasing the first input pressure results in the first pressure being higher than the second pressure such that the pressure differential is a positive pressure differential.

16. The method of claim 11 further comprising modifying an auger speed of an auger within the proppant supply passage in response to the first pressure and the second pressure.

17. The method of claim 11 further comprising wetting the proppant in the proppant addition unit to create a pressure seal between the gas in the proppant addition unit and the liquid frac fluid.

18. The method of claim 11 further comprising modifying the second input pressure to adjust only the second pressure.

* * * * *